US005718144A

United States Patent [19]

Korodan

[11] Patent Number: 5,718,144

[45] Date of Patent: Feb. 17, 1998

[54] DWELL CAM DRIVER FOR STAMPING PRESS

[75] Inventor: Theodore L. Korodan, Memphis, Mich.

[73] Assignee: Chrysler Corporation, Auburn Hills, Mich.

[21] Appl. No.: 623,063

[22] Filed: Mar. 28, 1996

[51] Int. Cl.[6] ..... B21D 5/01; B21J 9/18

[52] U.S. Cl. ..... 72/452.9; 72/297; 72/315

[58] Field of Search ..... 72/452.01, 452.02, 72/452.08, 452.09, 296, 297, 312, 314, 315

[56] References Cited

FOREIGN PATENT DOCUMENTS 62-296914 12/1987 Japan ..... 72/452.9

62-296915 12/1987 Japan ..... 72/452.9

*Primary Examiner*—David Jones

*Attorney, Agent, or Firm*—Lawrence J. Shurupoff

[57] ABSTRACT

A dwell cam driver for advancing a horizontal slide into engagement with a workpiece to be formed in a stamping press. The driver has a pivoted anvil and the slide also has a pivoted anvil. When the driver moves downwardly, cam faces on the anvils interengage. The anvils slide relative to one another and pivot from an inclined position to advance the slide, and finally to a vertical dwell position to retain the slide in the advanced position.

1 Claim, 3 Drawing Sheets

DWELL CAM DRIVER FOR STAMPING PRESS

FIELD OF INVENTION

This invention relates generally to cam drivers and more particularly to a dwell cam driver for advancing a slide into engagement with a workpiece to be formed in a stamping press.

BACKGROUND OF THE INVENTION

In stamping presses, a dwell cam driver is used for advancing a slide into engagement with a workpiece to be formed. The slide is advanced by a driver mounted on the upper shoe of the press. The driver typically has a cam formed with a beveled surface which engages a similarly beveled cam surface on the slide when the upper shoe comes down. During this downward movement of the upper shoe, a dwell point is reached where a connecting vertical surface on the cam carried by the driver slides down along a connecting vertical cam surface on the slide to lock the slide in the advanced position. Great pressures are required to hold the slide in its advanced position during stamping, and wear and galling, especially at the point of intersection between the inclined and vertical surfaces, often results. If the camming surfaces are not repaired, the slide will not be held in proper position, the workpiece will not be properly stamped and will have to be rejected. There is a considerable amount of downtime in the operation of these presses just to repair or replace the cams on the driver and on the slide. The cam surfaces can be made of hardened steel with a lubricant coating, but lubricants are messy and not desired. More often, one of the complementary cam surfaces is of hardened steel and the other is brass which is a softer metal, but the brass is more prone to wear and to require repair or replacement.

What is needed is a dwell cam driver design which will produce less wear on the parts and therefore longer lasting components which do not require frequent repair and/or replacement.

SUMMARY OF THE INVENTION

In accordance with the present invention, the driver and slide have pivoted anvils provided with flat cam surfaces rather than inclined and vertical intersecting surfaces as in the prior art. This avoids the build-up and concentration of pressures during the operation of the driver. When the anvils first make contact, they are inclined at about a 45° angle, but near the end of the downward travel of the driver, the anvils pivot to a vertical dwell position. Thus, the same cam surfaces which advance the slide also lock it in the advanced position, because of the pivotal mounting of the anvils.

Preferably, stops are provided for the two anvils to limit their pivotal movement.

Stampings formed by the use of dwell cam drivers constructed in accordance with this invention may be automotive door panels or hoods or tailgates or any other suitable sheet metal article.

One object of this invention is to provide a dwell cam driver for a stamping press having the foregoing features and capabilities.

Another object is to provide a dwell cam driver which is composed of a relatively few simple parts, is rugged and durable in use, and is capable of being inexpensively manufactured and readily operated.

These and other objects, features and advantages of the invention will become more apparent as the following description proceeds, especially when considered with the accompanying drawings.

DETAILED DESCRIPTION OF THE PREFERRED EMBODIMENT

Figure 1:
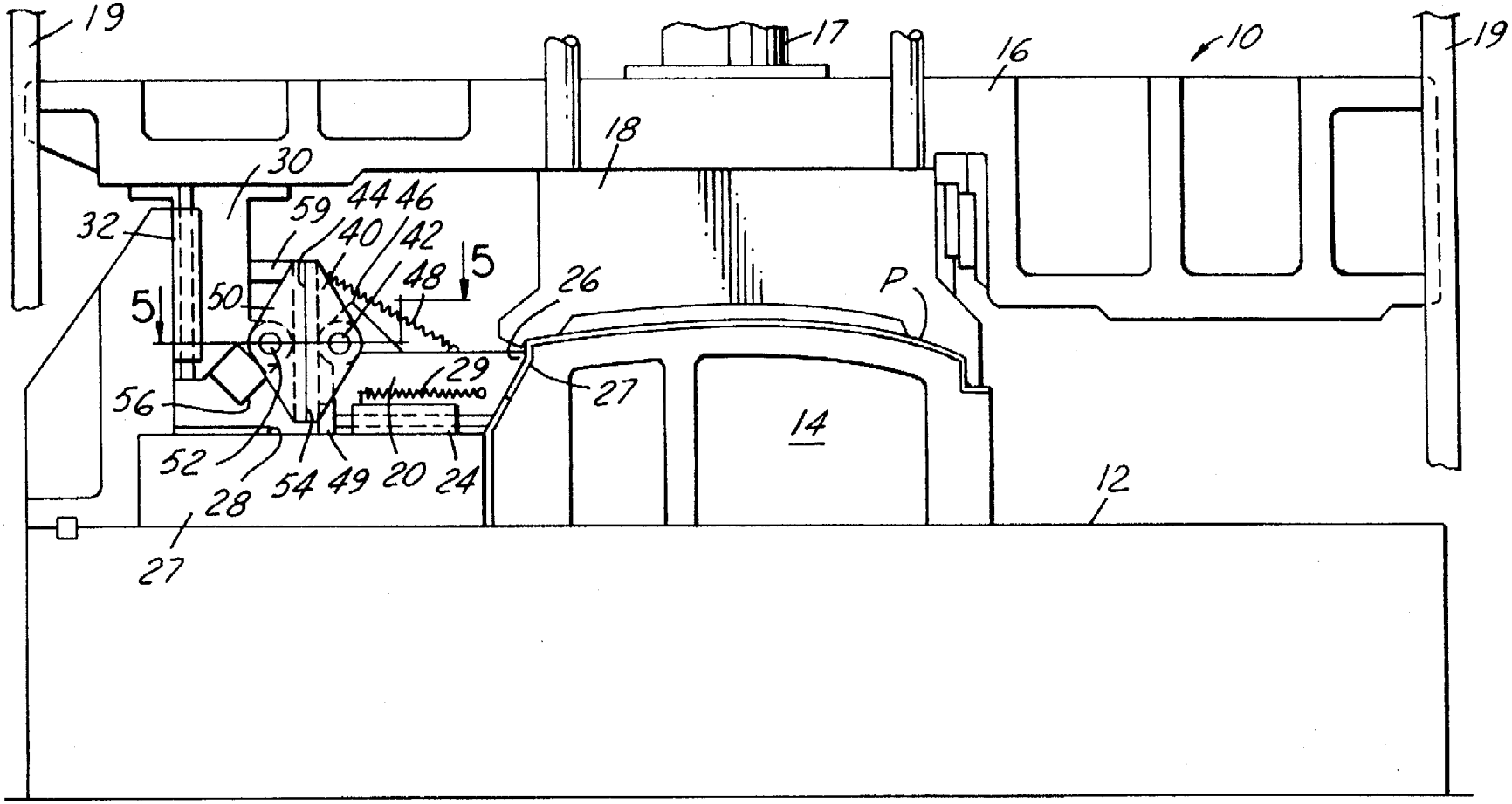
FIG. 1 is a front elevational view of a stamping press having a dwell cam driver constructed in accordance with the invention.

Referring now more particularly to the drawings, the stamping press 10 comprises a base 12 supporting a lower die 14, and a ram or upper shoe 16 which mounts an upper die 18 directly above the lower die. The upper shoe 16 is moved vertically by suitable power means 17 along ways 19 to cause the upper die 18 to come down on the lower die 14 and stamp a panel P therebetween.

A slide 20 is mounted on a base block 22 in ways 24 for horizontal sliding movement toward and away from the lower die 14. The slide is movable from a retracted position shown in FIG. 2 to an advanced position shown in FIGS. 1 and 4. When the slide is in the advanced position of FIG. 1, the nose 26 of the slide engages and presses and edge portion 27 of the panel against a side edge portion of the lower die 14 to hold the panel securely during the stamping operation. The retracted position of the slide is determined by its engagement with a stop 28. The slide is moved to its retracted position as by means of springs 29 attached at one end to the slide and at the other end to anchors on the ways 24.

A dwell cam driver 30 is rigidly mounted on the upper shoe so that it moves vertically with the upper shoe. The movement of the driver 30 is guided by ways 32 mounted on the base 12. The path of the driver is perpendicular to the path of the slide and extensions of the two paths intersect. The path of the driver is spaced rearwardly of the slide when the slide is in its retracted position.

An anvil 40, made of hardened steel, for example, is pivotally mounted on the slide 20 by a horizontal pin 42 which extends perpendicular to the path of the slide. The anvil 40 has a rectangular, smooth, flat cam face 44.

An anvil 50, preferably identical in size, shape and material to the anvil 40, is pivotally mounted on the driver 30 by a horizontal pin 52 which is parallel to the pin 42. The anvil 50 has a rectangular, smooth, flat cam face 54.

Figure 2:
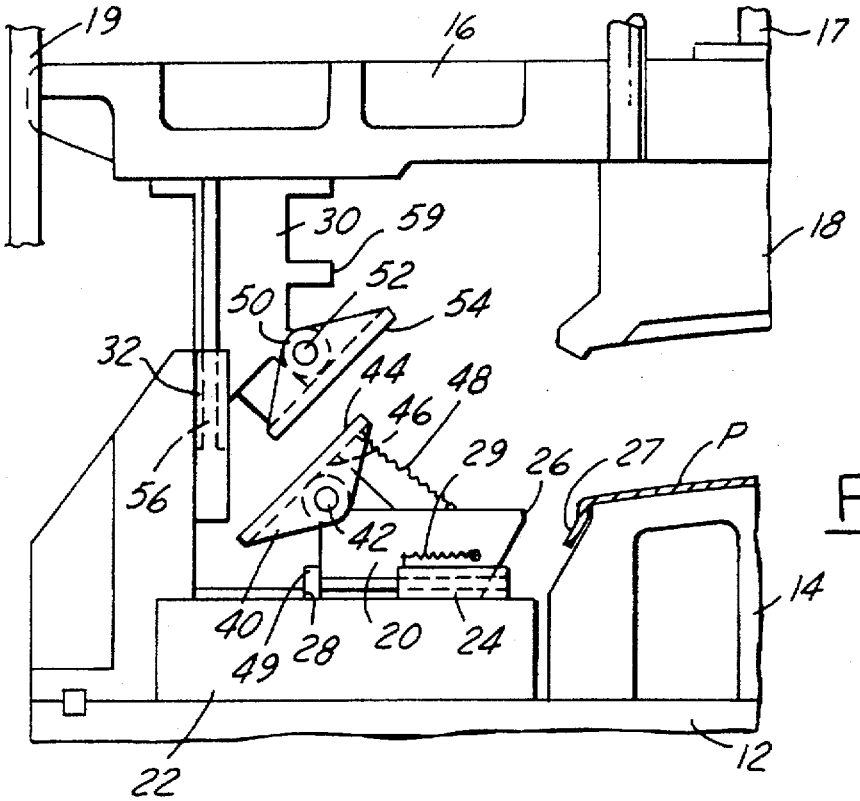
FIG. 2 is a fragmentary view showing the cam driver and its anvil in the upper or retracted position and showing the slide and its anvil also in retracted position, in preparation for a downward movement of the upper shoe of the press.

When the upper shoe 16 of the press is in the retracted or raised position of FIG. 2, so that the anvil 50 is spaced above and not in contact with the anvil 40, the anvil 40 assumes the inclined position shown, in which the upper portion thereof engages a stop or abutment 46 on the slide 20, being urged to that position by a spring 48 extending between the anvil 40 and the slide. In the inclined position of the anvil 40, its cam face is disposed at an acute angle to the horizontal, preferably 45°. The anvil 40 can pivot from the inclined position of FIG. 2 to the position of FIG. 1 in which its lower portion engages a stop or abutment 49 on slide 20 and its cam face 44 is vertical.

When the upper shoe 16 of the press is in the retracted or raised position of FIG. 2, the anvil 50 is directly above the anvil 40 and assumes the inclined position shown, in which the lower portion thereof engages a stop or abutment 56 on the driver. The anvil assumes this position by gravity because of the off-center location of the pivot pin 52. A spring may be added, if desired, to urge the anvil to the inclined position. In the inclined position of the anvil 50, its cam face is disposed at the same acute angle as the cam face of anvil 40. The anvil 50 can pivot from the inclined position of FIG. 2 to the position of FIG. 1 in which its upper portion engages a stop or abutment 59 on driver 30 and its cam face is vertical.

When the slide 20 is in the retracted position of FIG. 2, the path of the pivot pin 52 during vertical movement of the driver is somewhat to the rear of the pivot pin 42.

FIG. 2 shows the upper shoe 16 and driver 30 elevated, with the anvil 50 spaced above the anvil 40 and the slide 20 retracted. The anvils 40 and 50 are both in the inclined positions with the cam faces thereof at about a 45° angle to the horizontal. A panel P to be stamped rests on the lower die 14 and the upper die 18 is spaced above the panel.

Figure 3:
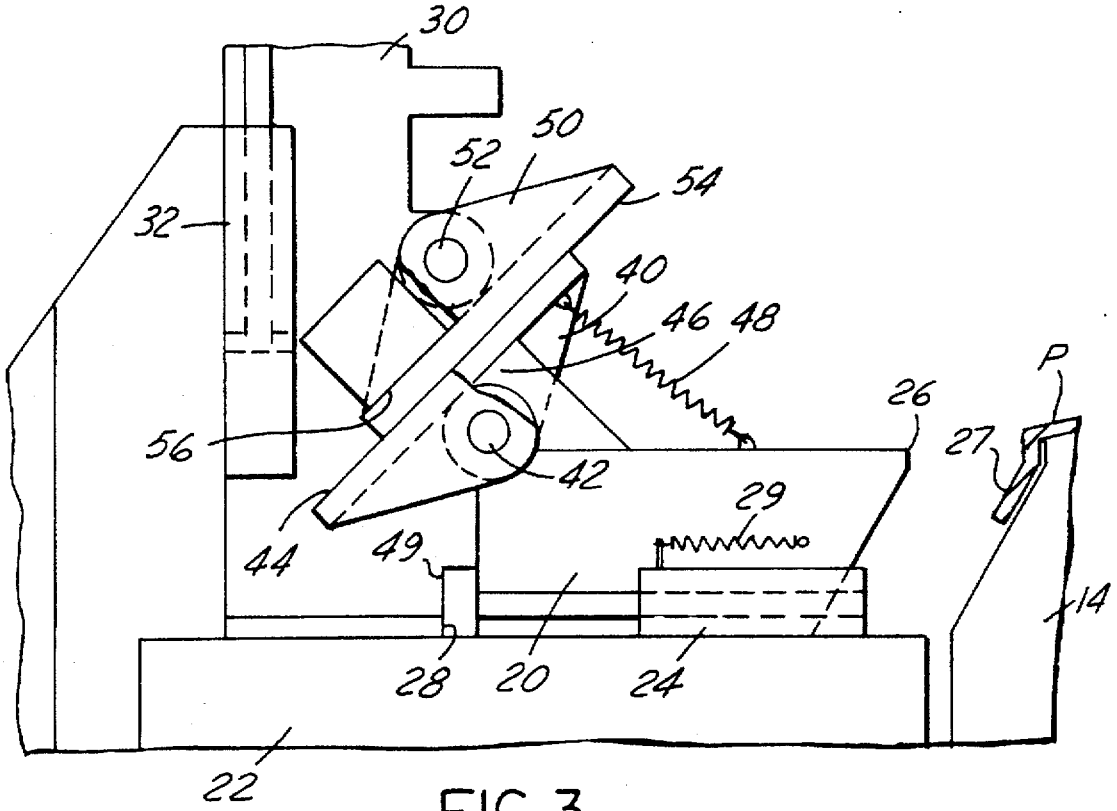
FIG. 3 is an enlarged fragmentary view similar to FIG. 2, but shows the parts after the driver has moved downwardly to an intermediate position in which the cam face on the anvil of the driver initially engages the cam face on the anvil of the slide.

FIG. 3 shows the upper shoe 16 after it has descended to an intermediate position in which the cam faces of the anvils 40 and 50 make initial contact. Continued downward movement of the upper shoe 16 causes the cam face 54 of anvil 50 to slide down along the cam face 44 of anvil 40, camming the slide 20 toward the lower die 14. During this time, the anvils 40 and 50 turn toward the position shown in FIGS. 1 and 4.

Figure 4:
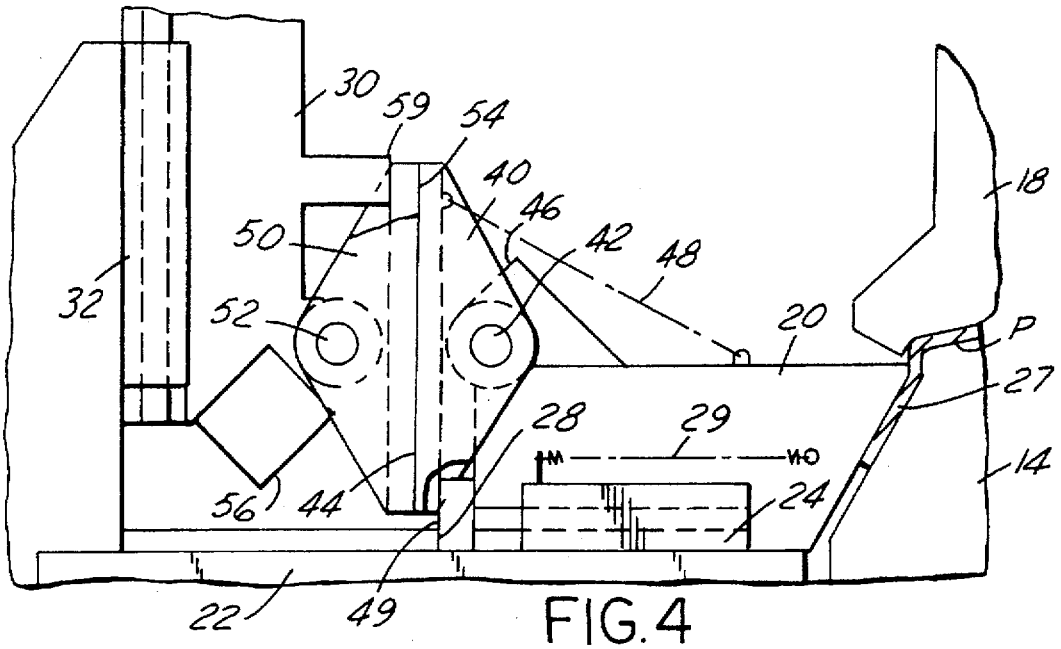
FIG. 4 is an enlarged fragmentary view similar to FIG. 2, but showing the cam driver in its lower or advanced position in which the anvils have swung to a dwell position where their contacting cam faces are vertical and the slide is locked in its advanced position.
Figure 5:
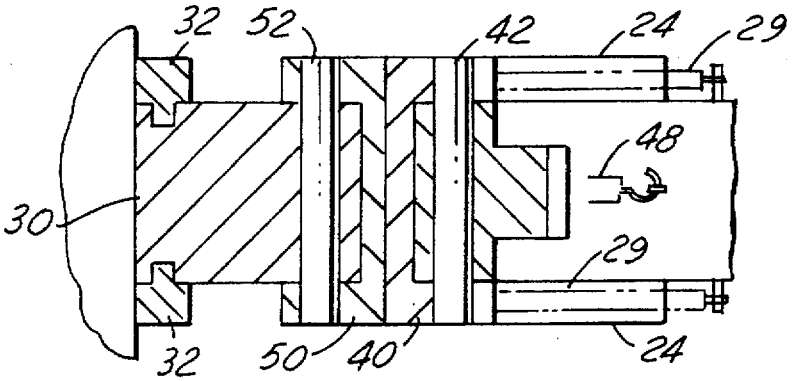
FIG. 5 is a fragmentary sectional view taken on the line 5—5 in FIG. 1.

FIGS. 1 and 4 show the upper shoe 16 at the bottom of its downward movement, in which the anvils 40 and 50 are in the dwell position retaining the slide 20 in its advanced position in which the nose 26 of the slide presses the edge portion 27 of the panel P against the lower die 14. The anvils actually reach this dwell position just prior to the final closing movement of the upper die 18 in which it engages the panel P and forms it against the lower die 14. The cam faces 44 and 54, after the dwell position is reached, continue to slide over one another until the final closing of the dies.

When the upper shoe rises back to the FIG. 2 position, the slide 20 is retracted by springs 29.

Figure 6:
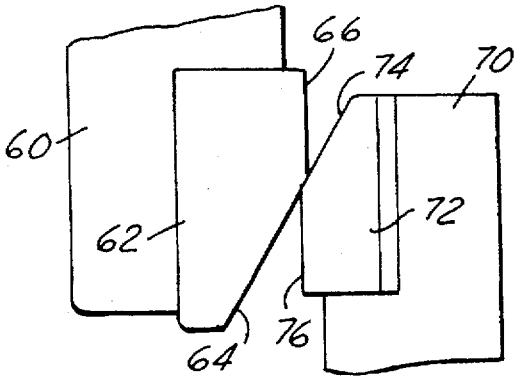
(PRIOR ART) FIG. 6
FIG. 6 is a diagrammatic view of a prior art construction in which both the cam on the driver and the cam on the slide are rigidly mounted and both are formed with intersecting inclined and vertical surfaces.
Figure 7:
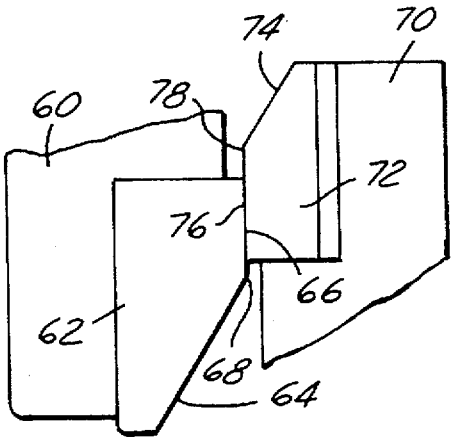
(PRIOR ART) FIG. 7
FIG. 7 is also a view of the prior art structure of FIG. 6, but showing the parts in a different position.

FIGS. 6 and 7 illustrate a prior art construction in which a vertically movable driver 60 has a rigidly mounted cam 62 and a horizontally movable slide 70 has a rigidly mounted cam 72. When the driver 60 moves downwardly, the inclined cam surface 64 of cam 62 contacts the inclined cam surface 74 of cam 72 to advance the slide to the right in FIG. 6. Further downward movement of the driver causes the vertical cam surface 66 of cam 62 to engage the vertical cam surface 76 of cam 72 at the dwell point shown in FIG. 7. However, extreme wear and galling occurs at the intersection 68 and 78 of the inclined and vertical cam surfaces, requiring repair and/or replacement of the cams.

What is claimed is:

1. Dwell cam driver apparatus for advancing a slide into engagement with a workpiece to be formed in a stamping press, comprising means for guiding the slide for reciprocation along a first predetermined path between a rearward and an advanced position, a first anvil having a flat first cam face, a first pivot mounting said first anvil on said slide for pivotal movement from a first position in which said first cam face is disposed at an angle of 45° to the first path to a second position in which said first cam face is perpendicular to the first path, a dwell cam driver, means for guiding said dwell cam driver in a direction perpendicular to said first path, a second anvil having a flat second cam face, a second pivot mounting said second anvil on said driver for pivotal movement from a first position in which said second cam face is disposed at an angle of 45° to the first path to a second position in which said second cam face is perpendicular to the first path, means normally positioning said first and second anvils in the first positions thereof so that the first and second cam faces are at a 45° angle to said first path, and power means, operative when said slide is in the rearward position thereof, to move the driver in said direction perpendicular to said first path from a retracted position in which the second cam face of said second anvil is spaced from the first cam face of said first anvil to an intermediate position in which said second cam face engages said first cam face, said power means being operative to continue to move said driver from said intermediate position to an advanced position in which said second cam face slides along said first cam face and said anvils are forced during such continued movement of said driver to said advanced position to rotate about their respective pivots to cause the contacting cam faces thereof to assume dwell positions perpendicular to said first path and said slide to be moved to and locked in its advanced position, the second pivot being movable with said driver along a second path which is spaced rearwardly of the first pivot when the slide is in the rearward position thereof, and the first and second pivots in the dwell positions of said cam faces, being located on a line parallel to said first path.

* * * * *